United States Patent [19]

Ishioka et al.

[11] Patent Number: 4,564,784

[45] Date of Patent: Jan. 14, 1986

[54] REDUCED DEGRADATION, HIGH RESOLUTION IMAGE PICKUP TUBE

[75] Inventors: Sachio Ishioka, Tokyo; Yoshinori Imamura, Kanagawa; Tadaaki Hirai, Koganei; Saburo Nobutoki; Akio Maruyama, both of Mobara, all of Japan

[73] Assignee: Hitachi, Ltd., Tokyo, Japan

[21] Appl. No.: 552,477

[22] Filed: Nov. 16, 1983

[30] Foreign Application Priority Data

Nov. 26, 1982 [JP] Japan ..... 57-206150

[51] Int. Cl.[4] ..... H01J 29/06; H01J 29/56; H01J 31/38

[52] U.S. Cl. ..... 313/384; 313/386; 313/390; 313/449

[58] Field of Search ..... 313/384, 385, 386, 390, 313/389, 311, 348, 293, 449

[56] References Cited

U.S. PATENT DOCUMENTS

| | | | |
|---|---|---|---|
| 2,922,907 | 1/1960 | Hannam | 313/311 X |
| 3,946,265 | 3/1976 | Verhoeven | 313/390 |
| 4,255,686 | 3/1981 | Maruyama et al. | 313/386 X |
| 4,363,996 | 12/1982 | Mizushima et al. | 313/449 |

FOREIGN PATENT DOCUMENTS

| | | | |
|---|---|---|---|
| 2415077 | 10/1974 | Fed. Rep. of Germany | 313/384 |

*Primary Examiner*—David K. Moore
*Assistant Examiner*—K. Wieder
*Attorney, Agent, or Firm*—Antonelli, Terry & Wands

[57] ABSTRACT

An image pickup tube comprising a target composed of a light-transmissible plate, a transparent electrode provided on said light-transmissible plate and a photoconductor made of hydrogen-containing amorphous silicon provided on said transparent electrode; an electron beam generator; and a mesh electrode near the aforesaid target, at least the surface of said mesh electrode being made of at least one member selected fromthe group consisting of Be, B, C, Mg, Al and Si, has high resolution with greatly improved life characteristics.

20 Claims, 5 Drawing Figures

REDUCED DEGRADATION, HIGH RESOLUTION IMAGE PICKUP TUBE

BACKGROUND OF THE INVENTION

This invention relates to an image pickup tube using amorphous silicon as a photoconductive layer, and particularly to an image pickup tube with greatly improved life characteristics in attaining high resolution.

An image pickup tube using amorphous silicon containing hydrogen (hereinafter abbreviated as "a-Si:H") as a photoconductive layer has high photo-sensitivity, low lag and excellent thermal stability, and can be used for various purposes.

Examples of such an image pickup tube are disclosed in U.S. Pat. No. 4,255,686, British Pat. No. 1,349,351, or U.S. patent application Ser. No. 491,921. The general constitution of an image pickup tube is disclosed in U.S. Pat. No. 4,363,996, etc.

One example of conventional image pickup tubes is shown in FIG. 1.

It comprises a beam current control section 1 and a main lens section 2. These sections comprise a thermoionic cathode 3, a first grid 4, a second grid 5, a beam disc 6, cylindrical electrodes 7, 8 and 9, a mesh electrode 10, and a photoconductive layer 11.

The operation of this image pickup tube is as follows. By irradiation of the photoconductive layer 11 with light, a certain information content is produced in proportion to the intensity of the light. This information content is outputed by scanning an electron beam from the thermoionic cathode 3 toward the photoconductive layer 11 by means of other electrodes.

The thus output information content is converted into desired signals by passing it through a predetermined circuit and is imaged, for example, on television.

SUMMARY OF THE INVENTION

This invention provides a novel constitution concerning the improvement of characteristics of an image pickup tube.

Recently, a demand for a picture image of high quality and high resolution has become progressively greater, and therefore research has been conducted with an aim of narrowing a scanning electron beam for an image pickup tube. In order to accomplish this aim, the scanning electron beam is accelerated by raising the voltage between a cathode and a mesh electrode. However, the present inventors found such a phenomenon that application of this method to an image pickup tube using a-Si:H degrades signal current voltage characteristics.

One example of the degradation phenomenon is shown in FIG. 2. This is a case of continuous operation for 200 hours at an electron beam acceleration voltage of 1,500 V. The initial characteristic signal current voltage characteristics shown by the curve 1 change as shown by the curve 2, and as a result, the signal current is decreased by 15% at a usual operation target voltage of 40 V.

This phenomenon is characteristic of an a-Si:H image pickup tube and has not been observed when the mesh electrode voltage is about 500 V as in the case of ITV (industrial television) cameras and the like.

An object of this invention is to reduce the above-mentioned degradation phenomenon greatly and to provide an amorphous silicon image pickup tube which has initial high characteristics for a long time even when scanned by high voltage accelerated electron beam.

This invention is an image pickup tube comprising a target using hydrogen-containing amorphous silicon as a photoconductor and a mesh electrode at least the surface of which is made of at least one member selected from the group consisting of beryllium, boron, carbon, magnesium, aluminum and silicon.

DETAILED DESCRIPTION OF THE INVENTION

Figure 3:
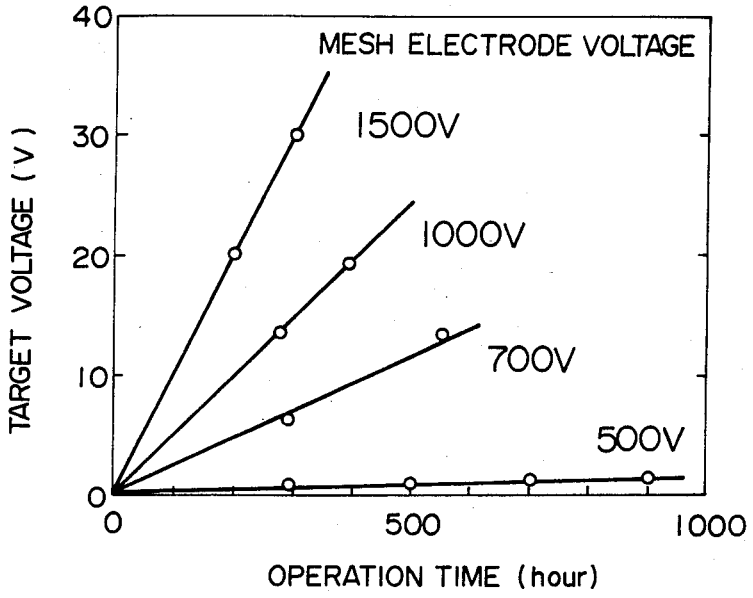
FIG. 3 shows a relationship between changes with the lapse of time of the above-mentioned current voltage characteristics and the voltage at a mesh electrode.

The present inventors have studied in detail the degradation phenomenon in the case of an image pickup tube using amorphous silicon as a photoconductive layer. FIG. 3 relates to the current voltage characteristics and shows a relationship between the change in target voltage $\Delta v$ necessary for obtaining the same signal and the voltage applied to a mesh electrode. As is clear from FIG. 3, the higher the mesh electrode voltage is, the larger the degradation of the current voltage characteristics is. As a result of more detailed investigation, it was found that the degradation was proportional to the square of the mesh electrode voltage and to the quantity of the electron beam.

Figure 1:
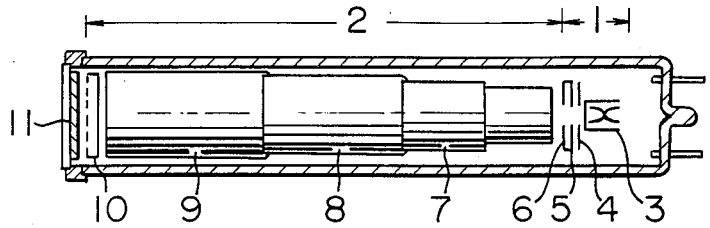
FIG. 1 PRIOR ART
FIG. 1 shows one example of conventional image pickup tubes.
Figure 4:
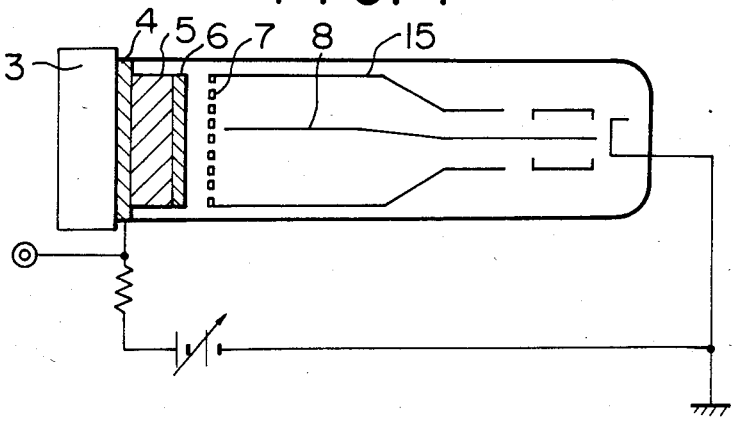
FIG. 4 illustrates the structure of an amorphous silicon image pickup tube.
Figure 2:
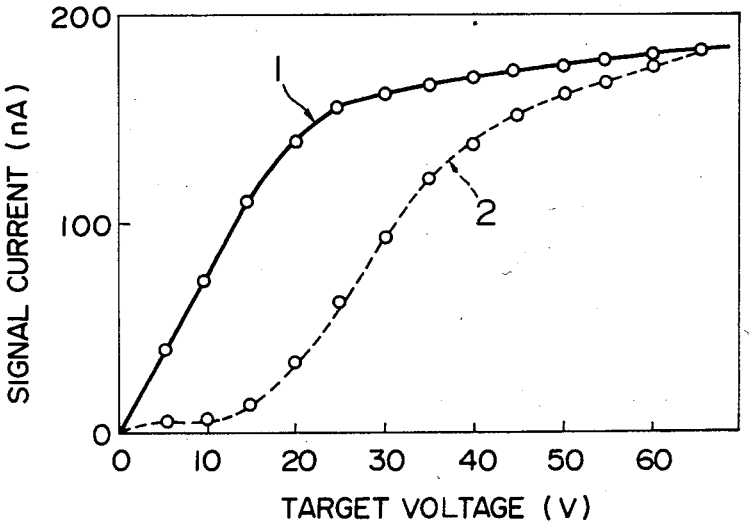
FIG. 2 shows changes in signal current of a conventional amorphous silicon image pickup tube due to continuous operation.

FIG. 4 shows the target structure of the image pickup tube. Numeral 3 denotes a light-transmissible plate such as a glass plate, numeral 4 a transparent electrode, numeral 5 an a-Si:H photoconductive layer, numeral 6 an electron beam landing layer, numeral 7 a mesh electrode, and numeral 8 an electron beam. The mesh electrode is maintained at the same potential as (or at a potential different from) that at a wall anode 15 and performs the function of decelerating the electron beam 8 and allowing the same to reach the target advantageously. The reason for the above-mentioned degradation in characteristics can be considered to be that the electron beam 8 collides with the mesh electrode 7 during image pickup, resulting in some influence on the a-Si:H layer.

As causes for the above-mentioned degradation in characteristics, there can be considered several causes, for example, the adhesion of a material used for producing the mesh electrode to the a-Si surface by sputtering and the diffusion thereof, and the generation of soft X-ray accompanying electron beam bombardment. In any case, the mesh electrode material is considered to take part in the above-mentioned degradation.

The above is elucidated by the following experiment.

As the mesh electrode material, copper is usually used, but the present inventors produced mesh electrodes by using various materials and examined their effects actually.

As a result, it was found that a mesh electrode made of at least one member selected from the group consisting of Be (beryllium), B (boron), C (carbon), Mg (magnesium), Al (aluminum) and Si (silicon) was effective for preventing the above-mentioned degradation in characteristics. In this case, the whole mesh electrode need not be made of such a material, and it is sufficient that the surface of the mesh electrode is coated with such a material. In the case of coating with such a material, there may be used, as a mesh electrode substrate, metals which have heretofore often been used such as Cu and the like. Insulating materials and the like may also be used if the object of the mesh electrode can be achieved by using a coating material. A means for the coating may be a conventional method. For example, a sputtering method, a vacuum evaporation method, CVD (chemical vapor deposition) and the like may be used. In the case of C and the like, a method using carbon-arc discharge may also be employed.

In order to obtain an effect, the thickness of the coating layer is about 50 Å or more as a standard and is sufficiently 100 Å or more. Further, a thickness up to 2,000 Å to 3,000 Å is usually used.

From the viewpoint of satisfactoriness of an effect of preventing the degradation in characteristics and the ease of the production, C or Al is very preferable as a material for the mesh electrode. Similarly, mesh electrodes having a structure in which coating with these materials has been carried out are practical.

This invention is illustrated by way of the following examples.

A target structure shown in FIG. 4 is formed by using, as a photoconductive layer, hydrogen-containing amorphous silicon which contains 3 to 30% by atom of hydrogen and 50% by atom or more of silicon.

As hydrogen-containing amorphous silicon, there are known those having undergone various dopings or those incorporated with carbon or germanium, and needless to say, they also are in the scope of this invention.

On a glass substrate 3, a transparent electrically conductive layer 4 is formed to a thickness of 300 nm for instance by the pyrolysis method of $SrCl_4$. On the upper part of the transparent electrically conductive layer 4, an a-Si:H photoconductive material layer 5 is formed to a thickness of about 2 μm. This a-Si:H photoconductive layer is obtained by a well-known method such as glow discharge CVD of monosilane glass, sputtering of silicon in a mixed gas of argon and hydrogen, or the like.

For example, reactive sputtering using pure poly silicon as a target plate is carried out in a mixed atmosphere of $3\times10^{-3}$ Torr of argon and $5\times10^{-3}$ Torr of hydrogen. In this case, the substrate is maintained at 250° C. In this case, the a-Si:H photoconductor contained about 13% by atom of hydrogen. Further, as a beam landing layer 6, an $As_2S_3$ (or $Sb_2S_3$) layer is formed to a thickness of 500 Å.

A target is thus constituted.

Such a target is combined with a mesh electrode obtained by coating the surface of a mesh electrode substrate made of Cu with Al to a thickness of 700 Å, and continuous operation was carried out at a mesh electrode voltage of 1,500 V.

As a result, high sensitivity of 650 μA/1 m or more in comparison with the initial sensitivity of 720 μA/1 m could be maintained even after continuous operation for 2,000 hours.

Further, when the target was combined with a mesh electrode obtained by coating a mesh electrode substrate made of Cu (or Al) with C to a thickness of 1,000 Å, the sensitivity was 700 μA/1 m or more even after operation for 2,000 hours, and thus there could be realized an amorphous silicon image pickup tube which withstands continuous use for a long time. In addition, the mesh electrode obtained by using C does not reflect light transmitted by the amorphous silicon photoconductive layer and hence brings about an effect of preventing the flare of a picture, so that a picture image of still higher quality can be obtained.

Materials effective for suppressing the degradation in signal cuttent of an image pickup tube using a-Si:H are Be, B, C, Mg, Al and Si and are summarized in the following table 1.

TABLE 1

| Mesh electrode material | Be | B | C | Mg | Al | Si | Cu | Au |
|---|---|---|---|---|---|---|---|---|
| Degradation-suppressing effect | ◎ | ◎ | ◎ | ○ | ○ | Δ | X | X |
| Ease of production | Δ | Δ | ○ | Δ | ○ | ○ | ○ | ○ |

The marks ◎, ○ and Δ in the "degradation-suppressing effect" line in the table express production of a degradation-suppressing effect in order of decreasing degree. The mark X expresses degradation. Also in the "Ease of production" line, the marks ○ and Δ express its degree in decreasing order. In the table, the materials Au and Cu are listed for comparison. The mesh needs not necessarily be made of these materials, and the purpose can sufficiently be achieved, for example, by coating a widely used copper mesh with these materials.

Figure 5:
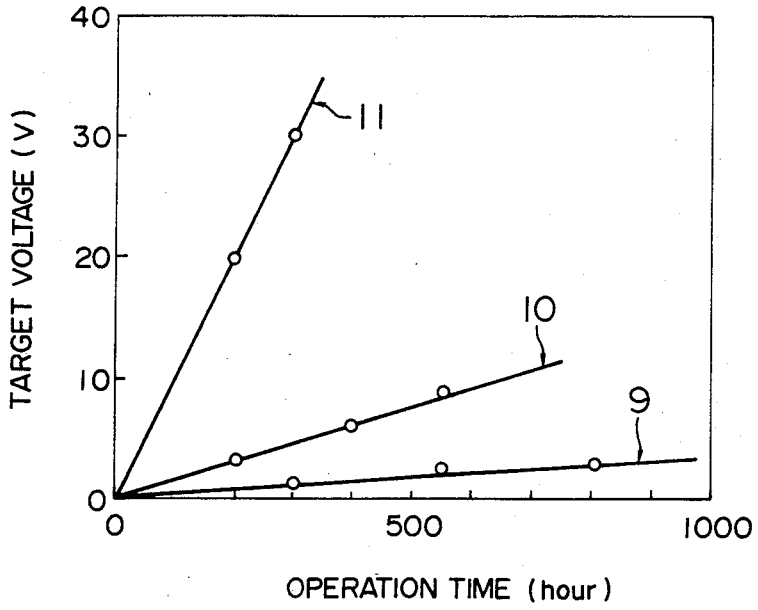
FIG. 5 shows a relationship between the mesh electrode materials of this invention and changes with the lapse of time of the current voltage characteristics.

Further, from the viewpoint of ease of the production, C and Al are preferred. In FIG. 5 is shown the degree of degradation caused when operation was carried out at a mesh electrode voltage of 1,500 V by using a C mesh (the straight line 9), an Al mesh (the straight line 10) and a conventional Cu mesh (the straight line 11). The actual change of the signal current was limited to 5% or less in the case of the Al mesh and 0.5% or less in the case of the C mesh after the operation for 1,000 hours, and an image pickup tube excellent in life characteristics can be provided by combining an a-Si:H photoconductive layer with the above-mentioned meshes.

As described above, according to this invention, the lowering of the sensitivity of an image pickup tube using amorphous silicon as a photoconductive layer can greatly be suppressed, and therefore there is brought about an effect of maintaining very high reliability when the present image pickup tube is used for home use, watching or the like.

What is claimed is:

1. An image pickup tube comprising a target composed of a light-transmissible plate, a transparent electrode provided on said light-transmissible plate, and a photoconductor made of hydrogen-containing amorphous silicon provided on said transparent electrode; an electron beam generator; and a mesh electrode near the target, at least the surface of said mesh electrode being made of at least one member selected from the group consisting of beryllium, boron, carbon, magnesium, aluminum and silicon.

2. An image pickup tube according to claim 1, wherein the mesh electrode is made of a copper substrate, the surface of which is coated with carbon or aluminum.

3. An image pickup tube according to claim 1, wherein the mesh electrode is made of an aluminum substrate, the surface of which is coated with carbon.

4. An image pickup tube according to claim 1, wherein a voltage of 500 V or higher is applied to the mesh electrode.

5. An image pickup tube according to claim 2, wherein a voltage of 500 V or higher is applied to the mesh electrode.

6. An image pickup tube according to claim 3, wherein a voltage of 500 V or higher is applied to the mesh electrode.

7. An image pickup tube comprising a target composed of a light-transmissible plate, a transparent electrode provided on said light-transmissible plate, and a photoconductor made of hydrogen-containing amorphous silicon provided on said transparent electrode; an electron beam generator; and a mesh electrode near the target, at least the surface of said mesh electrode facing the electron beam generator being made of at least one material selected from the group consisting of beryllium, boron, carbon, magnesium, aluminum and silicon.

8. An image pickup tube according to claim 7, wherein the mesh electrode is made of a copper substrate, the surface of which is coated with carbon or aluminum.

9. An image pickup tube according to claim 7, wherein the mesh electrode is made of an aluminum substrate, the surface of which is coated with carbon.

10. An image pickup tube according to claim 7, wherein a voltage of 500 V or higher is applied to the mesh electrode.

11. An image pickup tube according to claim 8, wherein a voltage of 500 V or higher is applied to the mesh electrode.

12. An image pickup tube according to claim 9, wherein a voltage of 500 V or higher is applied to the mesh electrode.

13. An image pickup tube comprising a target having a light-transmissible plate, a transparent electrode provided on the light-transmissible plate, and a photoconductor made of hydrogen-containing amorphous silicon provided on the transparent electrode; an electron beam generator; a mesh electrode; and means provided on the mesh electrode relative to the electron beam generator for reducing degradation of signal current-voltage characteristics of the tube.

14. An image pickup tube according to claim 13, wherein the degradation reducing means comprises a material provided on at least the surface of the mesh electrode, the material being selected from the group consisting of beryllium, boron, carbon, magnesium, aluminum and silicon.

15. An image pickup tube according to clami 13, wherein the material is provided on the surface of the mesh electrode facing the electron beam generator.

16. An image pickup tube according to claim 14, wherein the mesh electrode is made of a copper substrate, the surface of which is coated with carbon or aluminum.

17. An image pickup tube according to claim 14, wherein the mesh electrode is made of an aluminum substrate, the surface of which is coated with carbon.

18. An image pickup tube according to claim 14, wherein a voltage of 500 V or higher is applied to the mesh electrode.

19. An image pickup tube according to claim 16, wherein a voltage of 500 V or higher is applied to the mesh electrode.

20. An image pickup tube according to claim 17, wherein a voltage of 500 V or higher is applied to the mesh electrode.

* * * * *